United States Patent [19]

Iten et al.

[11] 3,972,417

[45] Aug. 3, 1976

[54] CUTTING BLADE PACKAGE

[75] Inventors: Clemens A. Iten; Sidney J. Rigby, both of Staunton, Va.

[73] Assignee: Philip Morris Incorporated, New York, N.Y.

[22] Filed: Apr. 1, 1975

[21] Appl. No.: 563,971

[52] U.S. Cl. ..... 206/354; 206/461; 206/493

[51] Int. Cl.[2] ..... B65D 65/16; B65D 83/10; B65D 85/62

[58] Field of Search ..... 206/461, 467, 470, 469, 206/493, 310, 352, 354, 355, 357

[56] References Cited

UNITED STATES PATENTS

| | | | |
|---|---|---|---|
| 1,607,602 | 11/1926 | Bindseil | 206/352 |
| 3,209,906 | 10/1965 | Kraut | 206/471 |
| 3,279,596 | 10/1966 | Prym et al. | 206/469 |
| 3,346,108 | 10/1967 | Wizelman | 206/469 |
| 3,530,981 | 7/1970 | Wienecke, Jr. | 206/310 |

FOREIGN PATENTS OR APPLICATIONS

| | | | |
|---|---|---|---|
| 264,112 | 1/1927 | United Kingdom | 206/354 |

*Primary Examiner*—William T. Dixson, Jr.
*Attorney, Agent, or Firm*—Watson Leavenworth Kelton & Taggert

[57] ABSTRACT

A package for a razor blade of the common double edge type having a central longitudinal slot with an enlargement of the slot near each end and at the middle portion, the package being adapted for display purposes and including a backing sheet of cardboard to the front of which is affixed a plastic bubble in the form of a tray with two or more posts projecting rearwardly from the bottom of the tray on which is threaded a blade, the posts having laterally projecting detents or other means for releasably holding the blade on the posts, and the card having a panel or tab at the back removable for access to the blade.

11 Claims, 10 Drawing Figures

FIG. 1
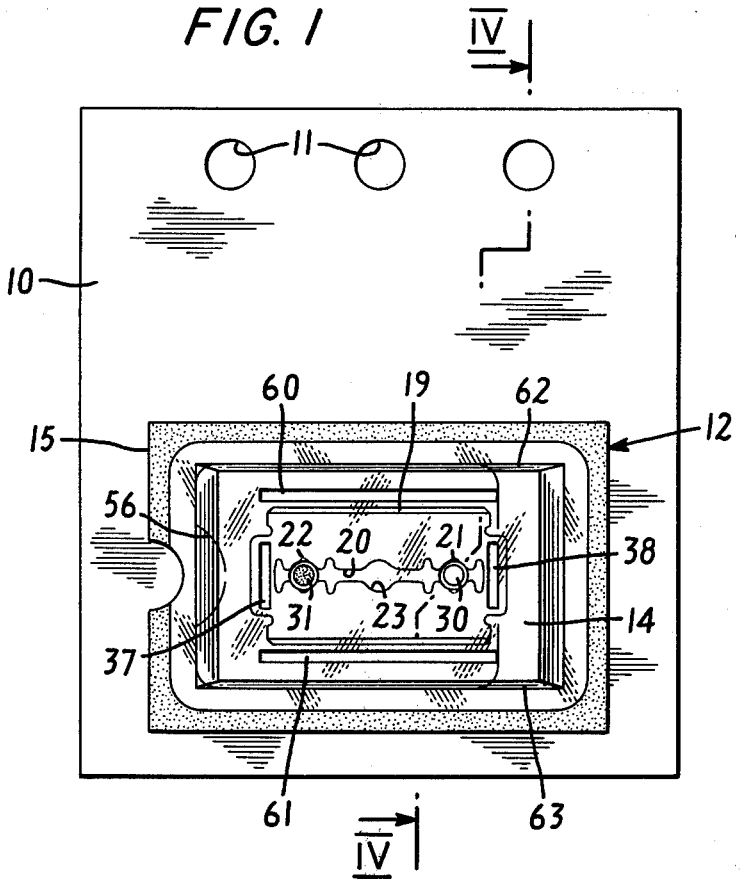
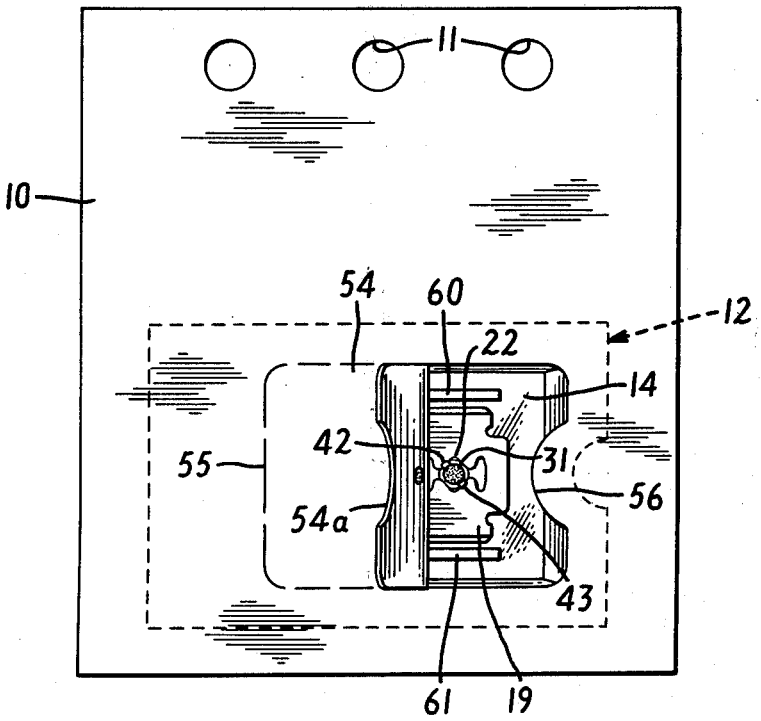
FIG. 2
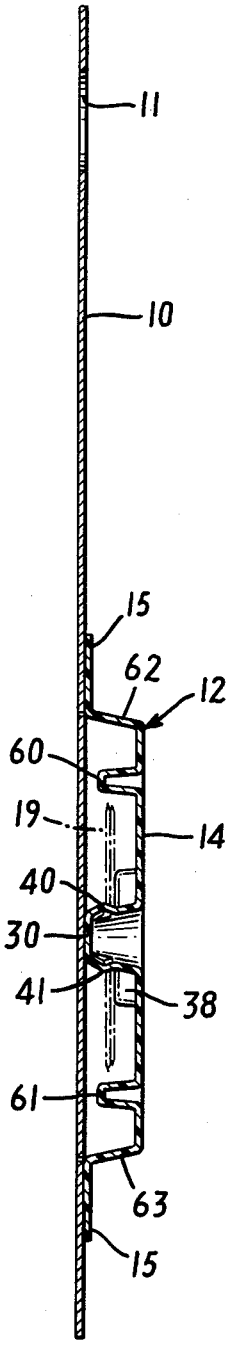
FIG. 4

CUTTING BLADE PACKAGE

The invention is concerned with a blade package, the blade particularly being of the common double edge type, and the package as a whole being adapted as a display package. A common double edge type blade having a central longitudinal slot is mounted in the preferred form of the invention in a transparent blister or bubble in the shape of a tray with posts extending upwardly from the bottom of the tray over which the blade is threaded and releasably held thereon by means which may vary but in the preferred form comprises detents or lugs projecting laterally from the posts. The blister is affixed to a supporting card on which may be printed desired identifying and advertising data, the card having a removable panel or tab at the rear for access to the cutting blade.

Other features and advantages will be made apparent from a consideration of the specific embodiments of the invention as depicted in the drawings in which:

FIG. 1 is a front plan or vertical view of the assembled package.

FIG. 2 is a rear view showing the removable panel in the process of being removed.

FIG. 4 is a cross sectional view taken on the plane IV—IV of FIG. 1.

Figure 3:
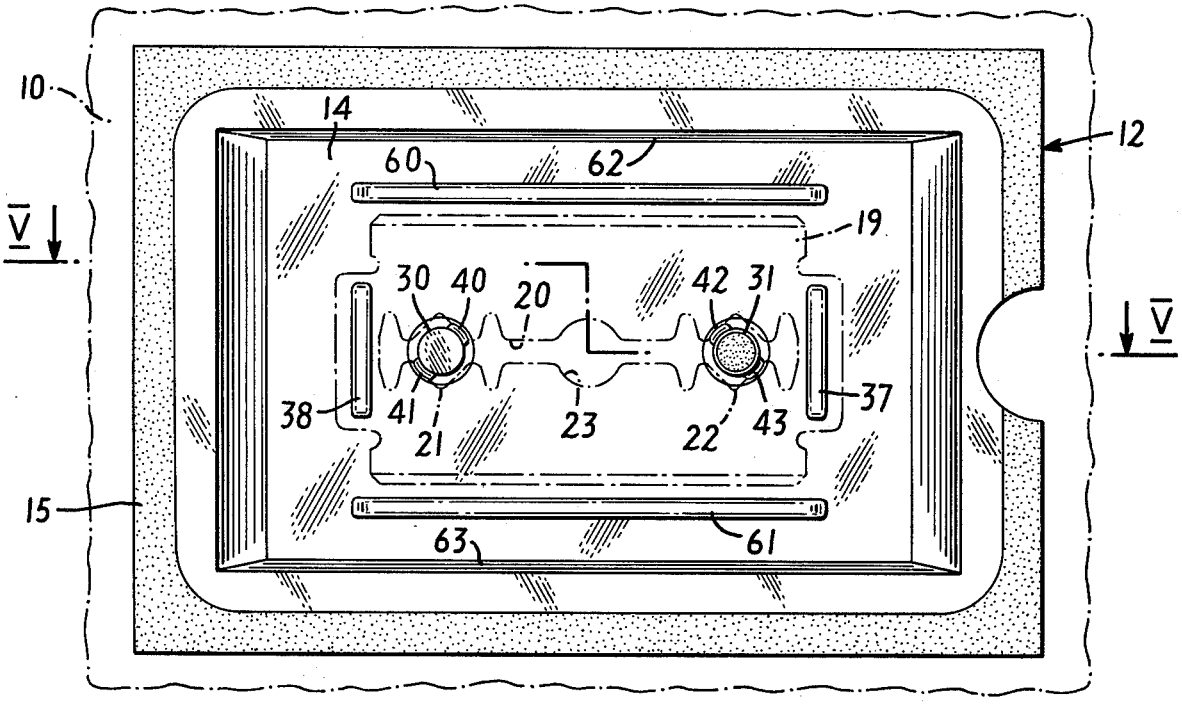
FIG. 3 is an enlarged rear view of one form of the plastic blister, the panel being removed and the razor blade being shown in broken lines.

An embodiment of the invention is shown in one form in FIGS. 1 to 5. It is particularly adapted for display purposes and includes a single blade only. It comprises a supporting card 10 which may have on its front face, appearing in FIG. 1, desired data and colored areas adapted to attract attention. It preferably has means for hanging the package if desired by means of the holes 11. Secured to the front of the supporting card is a blister member 12. As particularly indicated in FIGS. 4 and 5, the blister is in the form of a tray with a depressed area having a back wall 14 and a peripheral flange 15. The tray is adapted to support therein a blade 19 shown to be of a common double edge type having the usual longitudinal slot 20 therein and an expanded area near each end forming a generally diamond shaped hole 21 and 22 respectively, and a central generally round hole 23. The package is particularly intended to contain a single blade only as indicated at 19 in the broken lines in, for example, FIGS. 4 and 5. The blade may differ somewhat from that specifically shown and, for example, may be a twin or double blade secured together, each blade having a double edge and the edges at each side being offset from each other in accordance with the type of blade which has recently become well known. The blade is mounted on a pair of posts 30 and 31 projecting outwardly from the bottom wall 14 of the plastic tray with the posts 30 and 31 extending through the holes 21 and 22 of the blade respectively.

The blade is supported above the bottom wall of the tray by cross ribs 37 and 38. Means are provided for releasably holding the blade on the posts 30 and 31 which fit reasonably close within the respective blade holes but each post has one or more laterally projecting flexible detents or lugs behind which the blade is positioned. The character, numbers and position of the lugs may vary, as appears particularly in FIGS. 3 and 5. Each post has a pair of such lugs, those for the post 30 being indicated at 40 and 41, and those for the post 31 being indicated as lugs 42 and 43. It will be noted that the lugs at each post are arranged at opposite sides thereof and also that the lugs in each case extend at an angle of about 45° to a vertical diameter of the post as viewed in FIG. 3. With that arrangement the blade is well restricted against either the longitudinal or transverse movement in addition to being releasably held on the posts. As stated, the position and number of the lugs may vary and FIG. 6 shows the post 50 with a single lug 51 and correspondingly the post 52 with a single lug 53.

For removal of the blade the supporting card 10 is provided with a panel 54 defined by weakened lines as indicated at 55 in FIG. 2. The panel 54 preferably includes a scalloped edge 56 enabling the insertion of a fingernail to start the pealing away of the panel 54 as indicated at **54*a* in FIG. 2**.

In assembling the package the blade is first applied to the posts of the blister and pushed down below the holding lugs. The blister is then assembled to the front face of the card and adhesively secured thereto. Conveniently the card may have its front face coated over an appropriate area with heat sealable material whereby an application of a hot iron, which may be applied to the back of the card, and with the transfer of the heat to the forward face the flange 15 is sealed to the front face of the card.

Figure 5:
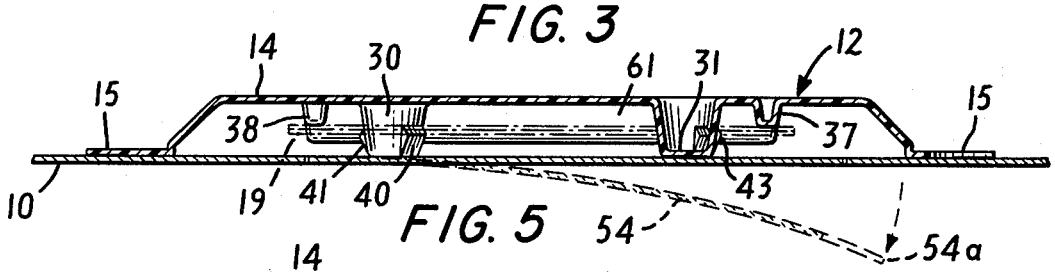
FIG. 5 is a cross sectional view taken on the plane V—V of FIG. 3 including the portion of the cardboard to which the bubble is attached.
Figure 6:
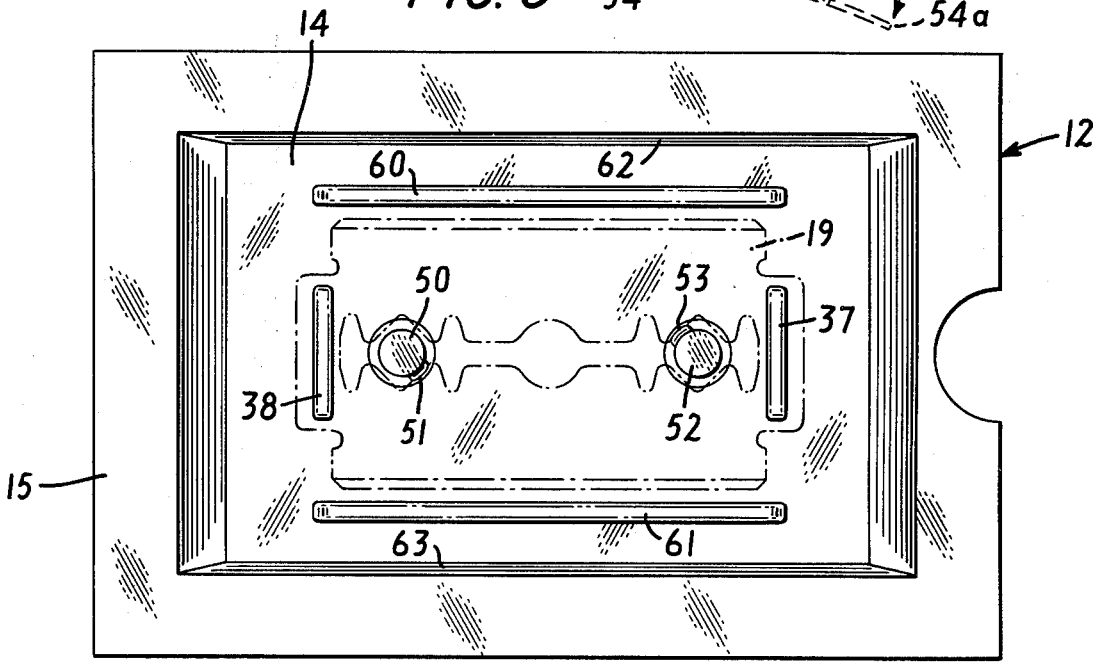
FIG. 6 is a rear view of a plastic blister showing a different arrangement of the detent holding means.

To obtain the blade the user of course first removes the panel 54 and then inserts a fingernail under the right end of the blade and rocks it outwardly on the cross rib 38 as a fulcrum (FIGS. 3 and 5). As may be noted from, for example, FIG. 5, the left end of the blade upon removal of the panel 54 is still underneath a portion of the supporting card which provides a safety measure restricting the user from grasping both ends of the blade to pull it away instead of being restricted to the rocking action just described. Preferably the overall diametral dimension of the lugs 42, 43 on the post 31 are slightly less than the corresponding diameter of the lugs on the post 31 whereby the right end of the blade is more easily released and the leverage applied on the fulcrum 38 serves to release the blade from that post.

The scallop 56 in the edge of the blister is provided as a convenience and safety in orienting the blister properly with respect to the panel opening in the rear to insure that the left end of the blade is covered over by a portion of the card when the panel is removed. As shown in the form of package described, a pair of ribs 60, 61 extending upwardly from the bottom wall of the blister forms barriers against the user inadvertently coming in contact with the cutting edges of the blade in removing it from the card. Other safety measures for that purpose may be employed as for example the walls 62, 63 of the blister may be formed closer to the respective blade cutting edges.

In addition to the means described for holding the blade on the posts, in heat sealing the blister to the card, simultaneously therewith heat may be applied over the top of either one or both of the posts 30, 31 whereby the flat top is sealed to the panel portion of the card. Such heat sealing of the posts may be as an alternative to the lugs on one or the other of the posts. As one arrangement the post 31 may have omitted therefrom the flexible holding lugs indicated at 42, 43 in FIG. 3 and the top of post heat sealed to the card. As noted for example in FIGS. 4 and 5 the posts are normally in contact with or in close proximity to the panel 54.

Figure 7:
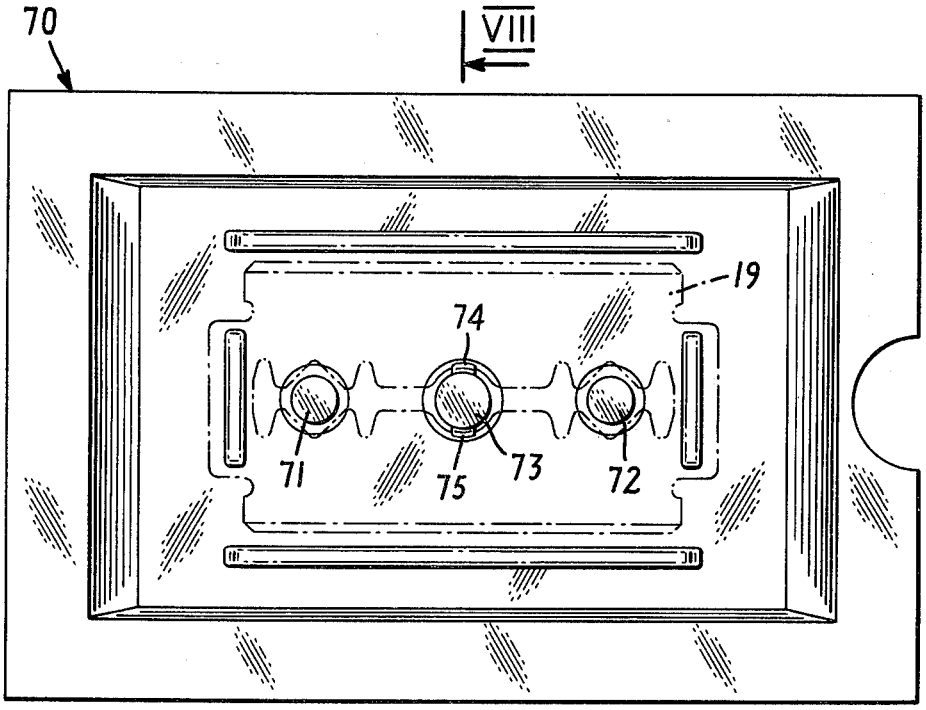
FIG. 7 is a view of a modified form of the plastic blister, the blade being shown in broken lines.
Figure 8:
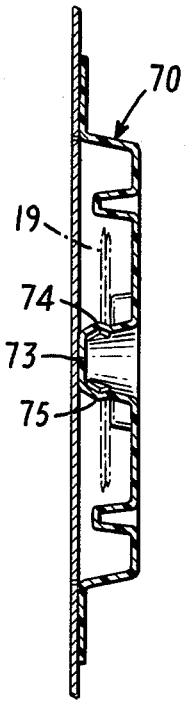
FIG. 8 is a cross sectional view taken on the plane VIII—VIII of FIG. 7.

FIGS. 7 and 8 show a modified arrangement in which the blister 70 has a middle post 73 over which the normally round hole in the middle of the blade is positioned and the post 73 has opposed flexible lugs 74 and 75 for releasably retaining the blade in position. The form of FIG. 7 as shown includes the end posts 71 and 72 but one or the other may be omitted since one end post will suffice to restrain the blade from rotating on the post 73 and the holding lugs on the end post or posts may be omitted.

Figure 9:
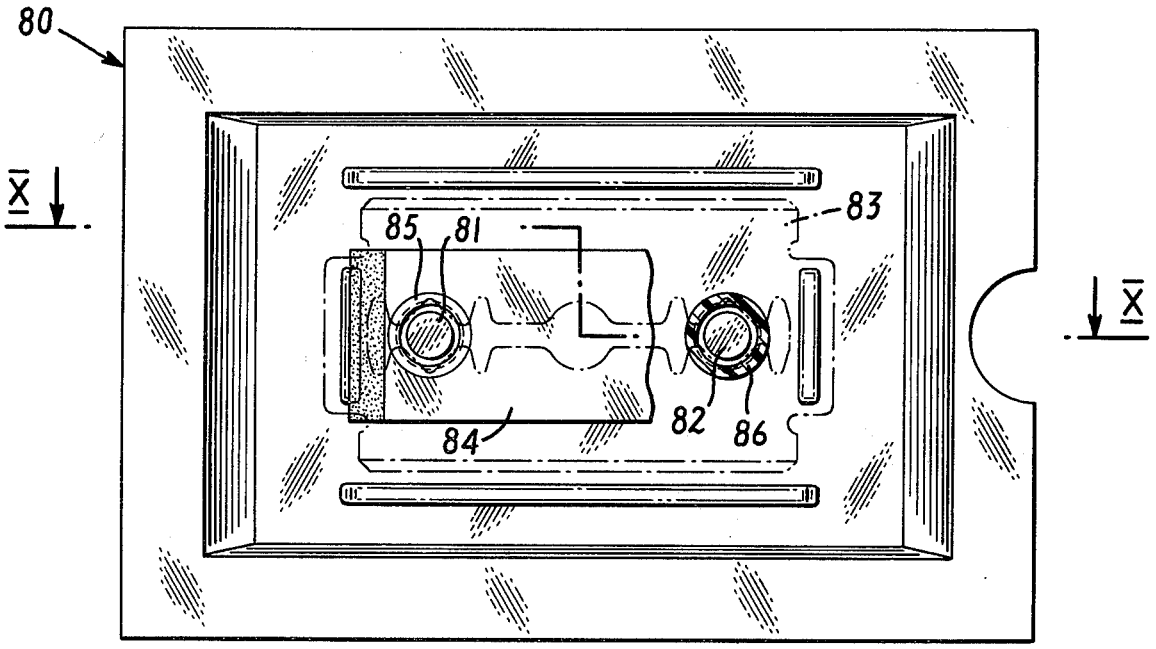
FIG. 9 is a rear view of a further modified form of the blister tray.
Figure 10:
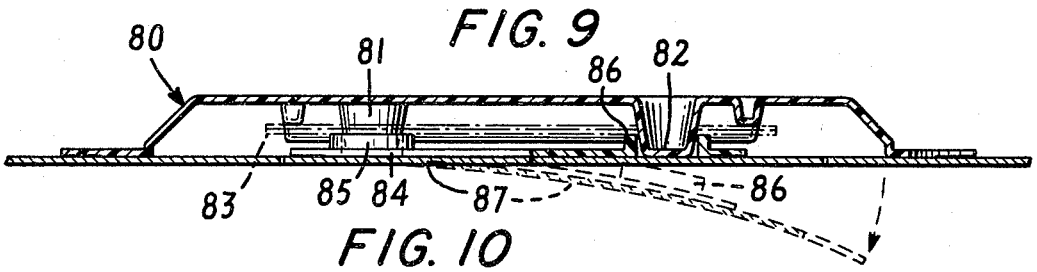
FIG. 10 is a cross sectional view taken on the plane X—X of FIG. 9.

FIGS. 9 and 10 depict a further modified form of blister 80 having posts 81 and 82. The means in this case for releasably holding the blade 83 in position comprising a plastic sheet member 84 having projecting tubular elements 85 and 86 telescoped over the post 81 and 82 respectively and engaging against the blade 83. Preferably the member 84 is secured to the removable panel 87 as by heat sealing, but it may be made and assembled to be separately removable after the panel 87 has been removed.

Since further various changes may be made in the blade package shown and described herein and accordingly different embodiments of the invention made, it is intended that all matter contained in the description or shown in the drawings shall be interpreted as illustrative and not in a limiting sense.

What is claimed is:

1. A cutting blade package comprising a tray having an indented elongated pocket with a bottom wall and an outer open face, spaced posts extending upwardly from the said bottom wall, a blade threaded over said posts, one or more of said posts having a laterally extending flexible detent lug under which the blade is engaged arranged and adapted to form means for releasably holding the blade on the posts, and a supporting card secured to the tray over said open face, said card having a panel over said open face displaceable for access to the blade.

2. A cutting blade package in accordance with claim 1 in which the blade is supported on the posts above the bottom wall and one end of the blade is exposed by removal of said panel to permit the insertion of a finger part under said one end for removal of the blade.

3. A cutting blade package in accordance with claim 2 in which said bottom wall has an outwardly extending rib to support the blade above the bottom wall.

4. A blade package in accordance with claim 2 in which the said panel is so shaped that the blade end opposite to said exposed end remains covered and protected against contact by the user's hand when said panel is removed.

5. A blade package in accordance with claim 1 in which said tray is of transparent plastic and has edge flanges sealed against said supporting card.

6. A cutting blade package in accordance with claim 1 in which said tray is a molded plastic article with laterally extending flanges heat sealed to said supporting card.

7. A cutting blade package in accordance with claim 6 in which the top of at least one of said posts is heat sealed to said supporting card.

8. A cutting blade package in accordance with claim 1 in which said panel is defined by weakened lines in said card.

9. A cutting blade package in accordance with claim 1 in which the outer end of one of said posts is cemented to said supporting card.

10. A cutting blade package in accordance with claim 1 in which there are a pair of spaced end posts extending upwardly through openings in the blade and a third post extending upwardly from said bottom wall through a middle opening in the blade, said third post having one or more laterally extending detent lugs under which the blade is located releasably holding the blade on the posts.

11. A cutting package comprising a tray of transparent plastic having an indented elongated pocket with a bottom wall and an outer open face, a pair of spaced posts extending upwardly from said bottom wall, a blade with holes threaded over said posts, outwardly extending projections arranged to support the blade above the bottom wall, a supporting card for said tray, the latter having edge flanges sealed to said card, said card having a panel located over the blade defining by weakened lines an opening exposing the blade when the weakened lines are broken, and means for releasably holding the blade on the posts comprising a sheet member with projecting tubular elements telescoped over each post.

* * * * *